US010105822B2

(12) United States Patent
Christen et al.

(10) Patent No.: US 10,105,822 B2
(45) Date of Patent: Oct. 23, 2018

(54) HOLDING DEVICE FOR A GRINDING MEANS

(71) Applicant: Robert Bosch GmbH, Stuttgart (DE)

(72) Inventors: Stefan Christen, Schneisingen (CH); Thomas Emler, Frauenfeld (CH); Beat Eugster, Buhwil TG (CH); Stephan Fritsch, Bottighofen (CH); Michael Gaenzler, Leinfelden-Echterdingen (DE); Roman Zaech, Mettlen (CH); Adrian Schoch, Warth (CH); Peter Eggenberger, Schönenberg (CH)

(73) Assignee: Robert Bosch GmbH, Stuttgart (DE)

( * ) Notice: Subject to any disclaimer, the term of this patent is extended or adjusted under 35 U.S.C. 154(b) by 372 days.

(21) Appl. No.: 14/901,068

(22) PCT Filed: Jun. 5, 2014

(86) PCT No.: PCT/EP2014/061662
§ 371 (c)(1),
(2) Date: Dec. 28, 2015

(87) PCT Pub. No.: WO2014/206700
PCT Pub. Date: Dec. 31, 2014

(65) Prior Publication Data

US 2016/0151887 A1 Jun. 2, 2016

(30) Foreign Application Priority Data

Jun. 28, 2013 (DE) ..... 10 2013 212 598

(51) Int. Cl.
*B24D 7/16* (2006.01)
*B24B 23/02* (2006.01)
(Continued)

(52) U.S. Cl.
CPC ..... *B24D 7/16* (2013.01); *B24B 23/02* (2013.01); *B24B 55/102* (2013.01); *B24D 9/08* (2013.01); *B24D 18/00* (2013.01)

(58) Field of Classification Search
CPC .. B24D 7/16; B24D 9/08; B24D 18/00; B24B 23/02; B24B 55/102
(Continued)

(56) References Cited

U.S. PATENT DOCUMENTS 2,819,568 A * 1/1958 Kasick ..... B24D 7/10 451/449
5,123,216 A * 6/1992 Kloss ..... B24B 23/04 15/97.1
(Continued)

FOREIGN PATENT DOCUMENTS

DE 27 42 062 A1 3/1978
EP 2 070 651 A1 6/2009
(Continued)

OTHER PUBLICATIONS

International Search Report corresponding to PCT Application No. PCT/EP2014/061662, dated Sep. 10, 2014 (German and English language document) (5 pages).

*Primary Examiner* — George Nguyen
(74) *Attorney, Agent, or Firm* — Maginot, Moore & Beck LLP

(57) ABSTRACT

A holding device, in particular a grinding disc, for a grinding member includes at least one support member that has at least one material opening configured for transverse transport of grinding dust to one side facing the grinding member in a plane parallel to a grinding surface. The holding device further includes at least one securing layer configured to secure the grinding member on the at least one support member. When decoupled from the grinding member, the at least one material opening is at least substantially open on a
(Continued)

side facing the grinding member and on a side facing away from the grinding member is substantially delimited by the support member.

17 Claims, 5 Drawing Sheets

(51) Int. Cl.
*B24B 55/10* (2006.01)
*B24D 9/08* (2006.01)
*B24D 18/00* (2006.01)

(58) Field of Classification Search
USPC ..... 451/342, 456
See application file for complete search history.

(56) References Cited

U.S. PATENT DOCUMENTS 7,029,384 B2 * 4/2006 Steimel ..... B24B 45/006 451/342
7,249,996 B1 * 7/2007 Volyar ..... B24B 7/184 451/354
7,364,500 B2 * 4/2008 Brown ..... B24B 55/10 451/354
2008/0081546 A1 4/2008 Takinami et al.
2008/0207099 A1 * 8/2008 Brown ..... B24D 9/003 451/524
2008/0318506 A1 12/2008 Brown
2009/0233527 A1 * 9/2009 Chung-Fat ..... B24B 45/003 451/28
2013/0210325 A1 * 8/2013 Schnyder ..... B24B 55/102 451/488
2013/0344783 A1 * 12/2013 Zaech ..... B24B 55/102 451/490

FOREIGN PATENT DOCUMENTS

GB 2 427 577 A 1/2007
JP H07-237131 A 9/1995
WO WO 2007143400 A2 * 12/2007 ..... B24B 55/102
WO 2009/088772 A2 7/2009

* cited by examiner

HOLDING DEVICE FOR A GRINDING MEANS

This application is a 35 U.S.C. § 371 National Stage Application of PCT/EP2014/061662, filed on Jun. 5, 2014, which claims the benefit of priority to Serial No. DE 10 2013 212 598.4, filed on Jun. 28, 2013 in Germany, the disclosures of which are incorporated herein by reference in their entirety.

BACKGROUND

In conventional grinding means and holding devices for grinding means, grinding means holes of the grinding means and suction holes of the holding device have to be lined up in an aligning step at the time of mounting in order to enable optimal suction of grinding dust during a grinding operation. A holding device, in particular a grinding disk, for a grinding means, said holding device having at least one support body, which comprises at least one material recess, which is provided for transverse transport of grinding dust on a side facing the grinding means in a plane parallel to a grinding face, and having at least one securing layer for securing the grinding means on the support body, has also already been proposed. Grinding dust is transported in this holding device through a dust-permeable hook-and-loop layer, whereby an aligning step when the grinding means is mounted on the holding device can be spared, however there is a risk of blockage of pores of the dust-permeable hook-and-loop layer, for example when grinding materials that contain resin.

SUMMARY

The disclosure proceeds from a holding device, in particular a grinding disk, for a grinding means, said holding device having at least one support body, which comprises at least one material recess, which is provided for transverse transport of grinding dust on a side facing the grinding means in a plane parallel to a grinding face, and having at least one securing layer for securing the grinding means on the support body.

When decoupled from the grinding means it is proposed for the at least one material recess to be at least substantially open on a side facing the grinding means and to be substantially delimited by the support body on a side facing away from the grinding means.

A "holding device for a grinding means" is to be understood to mean in particular a device that is provided to secure a grinding means and preferably to produce an operative connection of the grinding means to a grinding machine tool, in particular a handheld grinding machine tool, for example in order to generate a motor-driven rotation of the grinding means about an axis of rotation. In particular, the holding device comprises a face to which a grinding means, in particular a flexible grinding means, such as a velour-laminated grinding disk, is secured. A "grinding means" is to be understood to mean in particular a means having at least one layer formed from grinding particles, said means being provided to machine a surface in a grinding process and to attain a material removal on the surface. In particular, the grinding means comprises at least one grinding means backing and at least one layer formed from grinding particles, which layer is applied to the at least one grinding means backing and is secured on the grinding means backing by means of at least one securing means, in particular at least one securing layer formed from an adhesive. The layer formed from grinding particles is preferably loosely fixed to a surface of the grinding means backing by means of at least one layer formed from a base binder and is fixedly secured by means of at least one layer formed from a top binder. A "grinding means backing" is to be understood to mean in particular a body formed from a carrier material, for example a strip or a disk formed from a paper material, a cardboard material, a textile material, in particular a velour material, a film, a foam, a plastic and/or a metal. In particular, the grinding means backing may have a plurality of layers formed from the same or from different carrier materials. The grinding means backing is preferably strip-shaped or disk-shaped, however other shapes, for example a shape like a truncated cone or a hexagonal shape, are also possible in principle. The grinding means is preferably formed as a flexible grinding means. A "flexible grinding means" is to be understood to mean in particular a grinding means that has a flexible grinding means backing, for example a velour layer, a textile fabric and/or a paper layer, to which the at least one layer formed from grinding particles is applied. In particular, the flexible grinding means is provided to adapt at least partially to a surface shape. A "grinding particle" is to be understood to mean in particular a preferably ceramic, crystalline and/or metal body having at least one grinding edge. Depending on a desired application and a desired degree of fineness, the grinding particles have a diameter between ten mm and half a micrometer. A layer of grinding particles may contain, in principle, grinding particles having a defined geometry and/or grinding particles having an undefined geometry. The term "grinding particles having a defined geometry" is to be understood to mean in particular grinding particles that have at least substantially an identical and at least substantially predetermined shape, for example a rod shape or tetrahedral shape. In particular, grinding particles having a defined geometry have been produced by a process that purposefully produces grinding particles having the at least substantially predetermined shape. An "at least substantially identical shape" is to be understood to mean in particular that the grinding particles have an identical shape and preferably an identical size apart from deviations caused by the production process. The term "grinding particles having an undefined geometry" is to be understood to mean in particular grinding particles that have a number of at least substantially different and at least substantially random shapes. A "support body" is to be understood to mean in particular a body that provides at least one bearing face for the grinding means and that preferably consists at least partially of a flexible material, in particular a foam. The support body formed from flexible material is preferably provided to adapt resiliently to a surface shape of a surface to be ground. The at least one material recess is formed substantially as a surface material recess, for example as a channel or as a notch, wherein the material recess may have or may be connected to one or more hole elements, through which grinding dust is removed. The hole elements have an area corresponding to a maximum of ten percent, advantageously a maximum of five percent, and preferably a maximum of one percent of an area of the at least one material recess. In particular, the at least one material recess is different from a material through-hole, which extends from a side facing the grinding means to a side of the support body facing away from the grinding means. In particular, the at least one material recess is different from a material through-hole, which extends from a side of the support body facing the grinding means to a side of the support body facing away from the grinding means. The term "transverse transport" is to be understood to mean in particular a transport of grinding dust within a region surrounded at least partially by the support body, in particular within the support body, in which case the grinding dust is transported at least partially within a plane of the support body, in particular in a plane parallel to a grinding face, in order to pass from a location at which the grinding dust passes through the grinding means, in particular a grinding means hole, to a connection hole, which connects an area of the support body on the grinding means side to an area facing away from the grinding means. In particular, the transverse transport is different from a movement of grinding dust in a plane of the support body within grinding means holes and/or suction holes and from a transport of grinding dust within a transport channel extending at an incline through the support body, said transport channel interconnecting an end on the grinding means side and an end of a connection hole facing away from the grinding means. A "grinding face" is to be understood to mean in particular a face at which a material removal takes place by grinding in an operating mode. In particular, a grinding face is formed by a contact face of a grinding particle layer and a workpiece surface. A "securing layer" is to be understood to mean in particular a layer comprising securing means for securing the grinding means to the holding device, for example a layer formed from a hook-and-loop material. The term "when decoupled from the grinding means" is to be understood to mean in particular a state in which the holding device is fully mounted, in particular the securing layer is mounted on the support body, and the holding device is preferably mounted on a grinding machine tool, and the holding device, in particular the securing layer, is not connected to a grinding means. The term "side of the at least one material recess facing the grinding means" is to be understood to mean in particular a side facing the grinding means in a state coupled to the grinding means. A "side of the at least one material recess facing away from the grinding means" is to be understood in particular to mean a side facing away from the grinding means in the state coupled to the grinding means. In particular, the side facing the grinding means and the side facing away from the grinding means may be distinguished from one another in the state decoupled from the grinding means in that the securing layer is arranged on the side facing the grinding means. The term "at least substantially open" is to be understood to mean in particular that at least fifty percent, advantageously at least seventy percent and preferably at least ninety percent of an area of the at least one material recess is uncovered by the at least one securing layer in the state decoupled from the grinding means. In particular, an area of the at least one material recess may be completely uncovered by the securing layer in the state decoupled from the grinding means. In particular, the area of the at least one material recess is uncovered by the securing layer in the state decoupled from the grinding means and is covered by the grinding means in the state coupled to the grinding means. Further, the term "at least substantially open" in the case of material recesses is to be understood to mean in particular that at least fifty percent, advantageously at least seventy percent, and preferably at least ninety percent of a total area of the plurality of material recesses is uncovered by the at least one securing layer in the state decoupled from the grinding means. The fact that the at least one material recess "is substantially delimited by the support body on a side facing away from the grinding means" is to be understood to mean in particular that the material recess, on the side facing away from the grinding means, is delimited by the support body apart from individual hole elements, which account for a maximum area of ten percent, advantageously a maximum area of five percent, and preferably a maximum area of two percent of the material recess projected onto the side of the support body facing away from the grinding means. In particular, the individual hole elements of connection holes are formed on a side of the support body facing away from the grinding means and are intended to connect the at least one material recess fluidically to a suction device for suctioning grinding dust, such that transversely transported grinding dust is suctioned. In particular, material recesses delimited substantially by the support body on a side facing away from the grinding means are different from material through-holes, which extend from a side of the support body facing the grinding means to a side of the support body facing away from the grinding means, since material through-holes are not delimited by the support body on a side facing away from the grinding means.

In particular, one or more material recesses cover, over a wide area, a surface of the support body which faces the grinding means in a grinding operating mode, such that it is possible to dispense with a time-consuming alignment of the grinding means with the holding device in order to line up grinding means holes of the grinding means and suction openings of the holding device. In particular, a number, arrangement and area occupation on a side of the at least one material recess or plurality of material recesses facing the grinding means is selected such that, at least with a plurality of hole patterns of grinding means, and preferably with all hole patterns of grinding means, an at least partial overlap is achieved between grinding means holes of the grinding means and the at least one material recess or plurality of material recesses, without performing an aligning step, in which the grinding means is purposefully fitted onto the holding device in a certain orientation. In particular, at least ten percent of an area of the supporting body on the grinding means side is occupied by a material recess or by material recesses, such that a high transport capability and a high likelihood for an at least partial overlap can be achieved with different hole patterns of grinding means and material recesses, without the need for an aligning step in order to purposefully align a grinding means and the holding device relative to one another. As a result of the embodiment of the holding device according to the disclosure, a holding device can be provided in particular that can be used for different grinding means having different hole patterns of grinding means holes for a discharge of grinding dust, wherein it is possible to dispense with a time-consuming alignment of a respective used grinding means with suction holes of the holding device.

Furthermore, it is proposed for the at least one material recess to be formed as an inner region of a channel element. An "inner region of a channel element" is to be understood to mean in particular an elongate material recess, which has an extension in a longitudinal direction at least five times as great, advantageously at least ten times as great, and preferably at least twenty times as great as a maximum extension in a transverse direction. In principle, the channel element may be straight, may have at least one bend, or may be curved. In particular, a material recess having a high transport capability for grinding dust that is to be suctioned can be achieved.

It is also proposed for the channel element to be at least partially curved. An "at least partially curved channel element" is to be understood to mean in particular a channel element that has a curved course along at least ten percent, advantageously at least fifty percent, and preferably at least ninety percent of a total longitudinal extension. In particular, the at least partially curved channel element is formed as an annular channel or as a portion of an annular channel. A "curved course" is to be understood to mean in particular a course deviating from a straight course, in particular a course having a constant radius of curvature. In particular, it is possible to achieve a course of the material recess with which a formation of dead flow areas, in which dust collects on account of a flow separation, can be avoided particularly effectively.

In a development it is proposed for the at least partially curved channel element to be formed as a Fibonacci spiral element. A "spiral element" is to be understood to mean in particular an element, in particular a partial recess formed by a channel, which forms a spiral arm of a spiral structure, wherein the spiral arms, in particular toward a center region, may be connected to one another or may not be connected to one another. A "Fibonacci spiral element" is to be understood to mean in particular a spiral element having a course through corner points of adjacent squares arranged in succession in an anticlockwise or clockwise direction, wherein the side lengths of the squares arranged in succession in an anticlockwise or clockwise direction are arranged in a ratio to one another that is predefined by a Fibonacci sequence, wherein an orientation of the corner points of successive squares, through which the spiral element extends, likewise alternates in an anticlockwise direction. In particular, a spiral element having a particularly advantageous course can be achieved.

Furthermore, it is proposed for the support body to have a spiral structure formed from at least partially curved channel elements. A "spiral structure" is to be understood to mean in particular a structure having a number of spiral elements. In particular, a structure having material recesses that combines a high degree of coverage of possible hole patterns of grinding means holes with a high proportion of a securing area for securing the grinding means can be achieved.

Furthermore, it is proposed for the holding device to have island-like support protrusions, between which the at least one material recess is arranged. The term "support protrusions" is to be understood in particular to mean material elevations above a base area, of which the upper sides form a preferably flat support face.

The term "island-like support protrusions" is to be understood to mean in particular support protrusions that are surrounded by material recesses over an angular range of at least two hundred and seventy degrees, advantageously at least three hundred degrees, and preferably at least three hundred and thirty degrees. In particular, the at least one securing layer is arranged on upper sides of the island-like support protrusions. In particular, a high area occupancy of a surface of the holding device can be provided combined with a fixed adhesion by a plurality of engagement points of a securing on a grinding means, which engagement points are formed by the upper sides of the island-like support protrusions provided with the securing layer.

Furthermore, it is proposed for the holding device to have web elements, which interconnect the support protrusions and which straddle at least one material recess. The term "web elements" is to be understood to mean in particular preferably flat elements, which extend between the support protrusions and straddle the material recess. In particular, the at least one material recess is passed through below the web elements. In particular, a large area that can be provided with a securing layer can be achieved.

In accordance with a development it is proposed for the web elements to be formed integrally with the securing layer. The fact that "the web elements are formed integrally with the securing layer" is to be understood to mean in particular that the web elements are formed by elements of the securing layer and in particular are different from the support body. In particular, the securing layer is formed as a single layer element, in particular a single element formed from a hook-and-loop layer, which is connected to the support protrusions of the support body. In particular, a holding device with an easily producible attachment of the securing layer to the support body can be achieved.

It is also proposed for the holding device, in particular the support body, to comprise at least one material recess formed as an inner region of a peripheral annular channel. In particular when a portion of a material recess and/or of a connection hole is blocked, a diversion of a grinding dust flow via a further material recess and/or a further connection hole and therefore a robustness in respect of blockages can be achieved.

Furthermore, it is proposed for the holding device, in particular the support body, to comprise at least one peripheral support ring, which is free from material recesses. A "peripheral support ring" is to be understood to mean in particular an annular region that is formed free from material recesses along an entire course. In particular, a securing layer is arranged on an entire surface of the peripheral support ring. In principle, the peripheral support ring can be formed as a separate component additionally to the support body. In particular, a securing of the grinding means can be achieved with a high securing reliability.

Furthermore, it is proposed for the support body to have at least one connection hole for connection to a suction device, which is connected to the at least one material recess. A "connection hole" is to be understood to mean in particular a material through-hole through the support body, which through-hole is provided for a passage of grinding dust through the support body to a suction device, which at least conveys away the grinding dust from a region of a workpiece and preferably collects said dust in a dust collection container. In principle, the support body, instead of suction holes, may also have drainage holes, through which grinding dust can escape at sides. In particular, a holding device that enables work to be performed in a particularly dust-free environment can be achieved.

In accordance with a development of the disclosure it is proposed for the at least one connection hole to be formed by a center hole of the support body. This center hole is preferably fluidically connected to all material recesses. In particular, an advantageous positioning of the connection hole can be achieved.

Furthermore, it is proposed for the holding device to comprise at least one feed air opening, which is provided for a feed of air to assist the transverse transport of grinding dust. A "feed air opening" is to be understood to mean in particular a material through-hole in the support body, which through-hole advantageously extends from a side of the support body facing the grinding means to a side of the support body facing away from the grinding means, and via which through-hole a feed of air to a support body is provided in order to generate an airflow to assist the transverse transport of grinding dust in the at least one material recess and in a grinding gap between the grinding means and a workpiece. Alternatively, the at least one feed air opening could extend from a side of the support body facing the grinding means to a side of the support body oriented at least partially perpendicularly to the grinding means. A high transport capacity of the grinding means can be achieved in particular.

In accordance with a development of the disclosure it is proposed for the at least one feed air opening to be formed by a center hole of the support body. In particular, an advantageous positioning of the feed air opening and a uniform airflow can be achieved.

Furthermore, a grinding apparatus, in particular a handheld grinding apparatus, having a holding device according to the disclosure is proposed. A "grinding apparatus" is to be understood to mean in particular an apparatus, preferably an electric or pneumatic apparatus, which is provided in order to grind workpieces by way of a grinding means. The grinding apparatus is preferably formed as a handheld grinding apparatus for operation by a person. Alternatively, the grinding apparatus may be secured by way of example to a working arm of an industrial robot or may be integrated therein.

Furthermore, a method for producing a holding device according to the disclosure is proposed. The support body is advantageously fabricated in a process in which it is foamed onto a securing layer, which is preferably formed as an individual part. Here, the support body is preferably fabricated as a foam body, and the securing layer is formed as a hook-and-loop layer. In particular, it is possible to produce the holding device easily in an uncomplicated manner.

A system formed from a holding device according to the disclosure and a grinding means is also proposed.

The holding device according to the disclosure is not to be limited here to the above-described application and embodiment. In particular, in order to perform a functioning described herein, the holding device according to the disclosure may have a number of individual elements, components and units deviating from a number specified herein.

BRIEF DESCRIPTION OF THE DRAWINGS

Further advantages will emerge from the following description of a drawing. Nine exemplary embodiments of the disclosure are presented in the drawings. The drawings, the description and the claims contain numerous features in combination. Where appropriate, a person skilled in the art will also consider the features individually and combine them to form expedient further combinations.

In the drawings.

DETAILED DESCRIPTION

Figure 1:
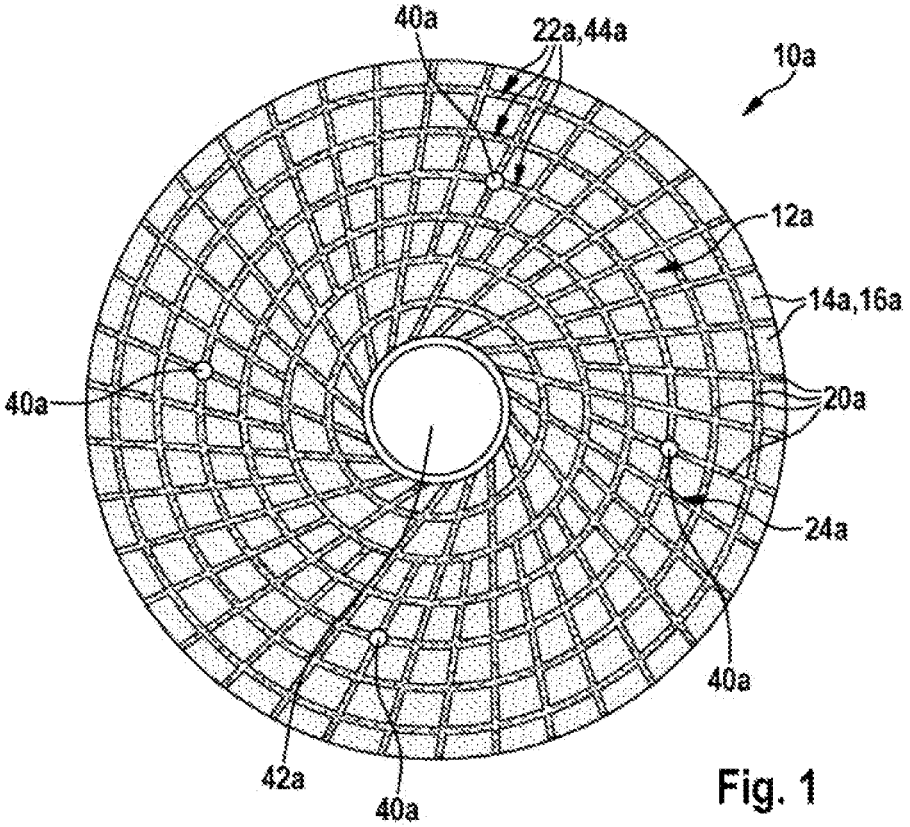
FIG. 1 shows a holding device according to the disclosure with a plurality of material recesses and island-like support protrusions, in a view from above.
Figure 2:
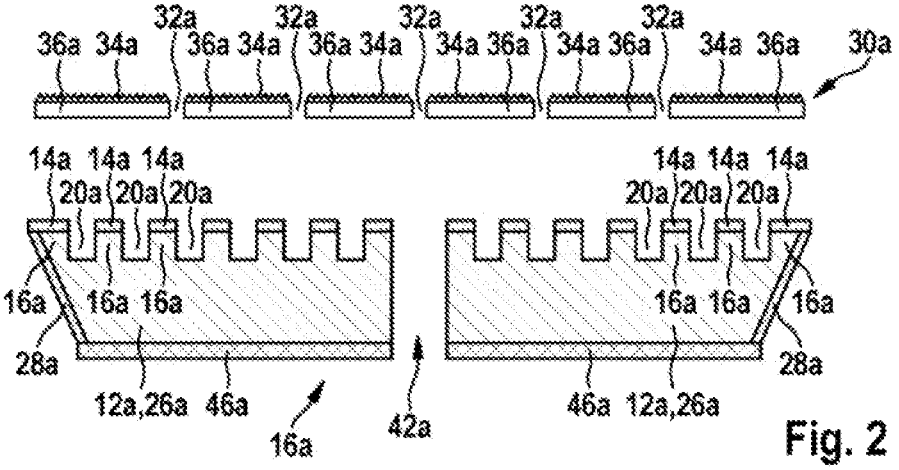
FIG. 2 shows a cross section through the holding device according to the disclosure according to FIG. 1 and a grinding means.

FIG. 1 shows a holding device 10*a*, formed as a grinding disk, for a grinding means 30*a* (see FIG. 2), having a support body 12*a*, which comprises material recesses 20*a*, which are provided for transverse transport of grinding dust on a side facing the grinding means 30*a* in a plane parallel to a grinding face 24*a*, and having a securing layer 14*a* for securing the grinding means 30*a* on the support body 12*a*. The material recesses 20*a*, when decoupled from the grinding means 30*a*, are substantially open on a side facing the grinding means 30*a* and are substantially delimited by the support body 12*a* on a side facing away from the grinding means 30*a*. The material recesses 20*a* are completely uncovered by the securing layer 14*a*, wherein, when decoupled from the grinding means 30*a*, the securing layer 14*a* is arranged on the support body 12*a*, but the grinding means 30*a* is not yet secured to the securing layer 14*a*. The holding device 10*a* has island-like support protrusions 16*a*, between which the material recesses 20*a* are arranged. The island-like support protrusions 16*a* are enclosed on all sides by the material recesses 20*a* and/or a center hole 42*a* of the support body 12*a* or an outer side of the holding device. The securing layer 14*a* is arranged on an upper face of the island-like support protrusions 16*a*, said upper side being arranged on the grinding means side (FIG. 2). The securing layer 14*a* is formed as a hook-and-loop layer, which secures a grinding means backing 36*a* of the grinding means 30*a*, which backing is formed as a velour layer. The material recesses 20*a* are formed partially as inner regions of straight longitudinal channels, which extend radially toward the center hole 42*a*, and partially as inner regions of curved channel elements 22*a*, which extend at a fixed radius around the center hole 42*a*. The material recesses 20*a* formed as inner regions of curved channel elements 22*a* are thus formed as an inner region of peripheral annular channels 44*a*. Approximately twenty percent of an area of the support body 12*a* on the grinding means side is occupied by the material recesses 20*a*. The support body 12*a* has connection holes 40*a* for connection to a suction device, said connection holes being connected to the at least one material recess 20*a*. In the illustrated exemplary embodiment four connection holes 40*a* are distributed over the support body 12*a*, wherein, in principle, different numbers of connection holes 40*a* may be formed in the support body 12*a*. The holding device 10*a* is provided to connect the grinding means 30*a* to an electric grinding apparatus formed as a handheld grinding apparatus. In principle, the grinding apparatus may also be secured to a robot, and/or integrated therein, for an automated machining of a workpiece. Due to a forming of a number of material recesses 20*a* as inner regions of annular channels 44*a*, in the event of the blockage of a material recess 20*a* formed as a longitudinal channel, said blockage being caused for example by grinding dust of resin-containing materials or by foreign bodies such as adhesives, grinding dust can be conveyed to the connection hole 40*a* via the annular channel 44*a* and a further material recess 20*a* formed as an inner region of a longitudinal channel.

For a machining of a workpiece, a grinding means 30*a* is secured to the holding device 10*a* (FIG. 2). The system formed from holding device 10*a* and grinding means 30*a* is then secured to the grinding apparatus. The grinding means 30*a* comprises the grinding means backing 36*a*, formed as a velour layer, and a grinding particle layer 34*a* applied thereto and formed from grinding particles. The grinding particles are preferably produced from a ceramic material and preferably have a defined shape predetermined by a production process. The grinding particles in the grinding particle layer 34*a* are fixed to a surface of the grinding means backing 36*a* by means of the first adhesive layer formed from a base binder and are fixedly connected to the grinding means backing by means of a second adhesive layer formed from a top binder. The grinding means 30*a* has grinding means holes 32*a* for discharging grinding dust produced during a grinding operation, said grinding means holes being arranged in a hole pattern. Following a coupling of the grinding means 30*a* to the holding device 10*a*, grinding dust enters the material recesses 20*a* through the grinding means holes 32*a* during the grinding operation and is conveyed via these recesses to the connection hole 40*a* and is removed by the suction device. Due to the material recesses 20*a*, in particular due to a wide-area coverage of the surface of the support body 12*a* on the grinding means side by the material recesses 20*a*, it is possible to dispense with a specific alignment of the grinding means 30*a* on the holding device 10*a* in order to line up grinding means holes 32*a* with connection holes 40*a* of the support body 12*a*, whereby a time-consuming step can be saved when mounting the grinding means 30*a* on the holding device 10*a*. In particular, an exchange of the grinding means 30*a* on the holding device 10*a* can thus be performed quickly. The support body 12*a* of the holding device 10 is formed integrally with a foam body 26*a* of the holding device 10*a*, which foam body consists of a foam material and provides a deformable support body for the grinding means 30*a*, which allows an adaptation of the grinding face 24*a* to contours of the workpiece. In alternative embodiments of the holding device 10*a* according to the disclosure, it is conceivable for the support body 12*a* to be formed as a separate component compared to the foam body 26*a*, for example as a support disk, which is fitted onto the foam body 26*a*. The holding device 10*a* comprises a base plate 46*a* formed from fiberglass, which achieves a termination of the foam body 26*a* on the grinding apparatus side and provides a firm surface for the foam body 26*a*. The holding device 10*a* also comprises a cladding layer 28*a*, which is arranged at lateral edges of the foam body 26*a* and consists of a foam material having a greater strength than a material of the foam body 26*a*. The cladding layer 28*a* protects the foam body 26*a* against damage. In principle, the holding device 10*a* may be formed without the cladding layer 28*a* and/or base plate 46*a* and may comprise merely a foam body 26*a*, a support body 12*a* and a securing layer 14*a*. The holding device 10*a* is secured to the grinding apparatus by way of any means appearing expedient to a person skilled in the art, for example using screw connections, which connect the base plate 46*a* and the grinding apparatus. In a method for producing the holding device 10*a*, a securing layer 14*a* is inserted into an accordingly formed foam tool, and the support body 12*a* is fabricated by being foamed on against the securing layer 14*a*. Alternatively, the support body 12*a* can be produced first, wherein the material recesses 20*a* are created during the production of the support body 12*a* or in a separate production step, and the securing layer 14*a* is then applied to the island-like support protrusions 16*a*.

Eight further exemplary embodiments of the disclosure are shown in FIGS. 3 to 13. The following descriptions and the drawings are limited fundamentally to the differences between the exemplary embodiments, wherein, with respect to identically named components, in particular with respect to components having identical reference signs, reference is also made in principle to the drawings and/or the description of the other exemplary embodiments, in particular FIGS. 1 to 2. In order to distinguish the exemplary embodiments, the letter a follows the reference signs of the exemplary embodiment in FIGS. 1 to 2. In the exemplary embodiments of FIGS. 3 to 13, the letter a is replaced by the letters b to i.

Figure 3:
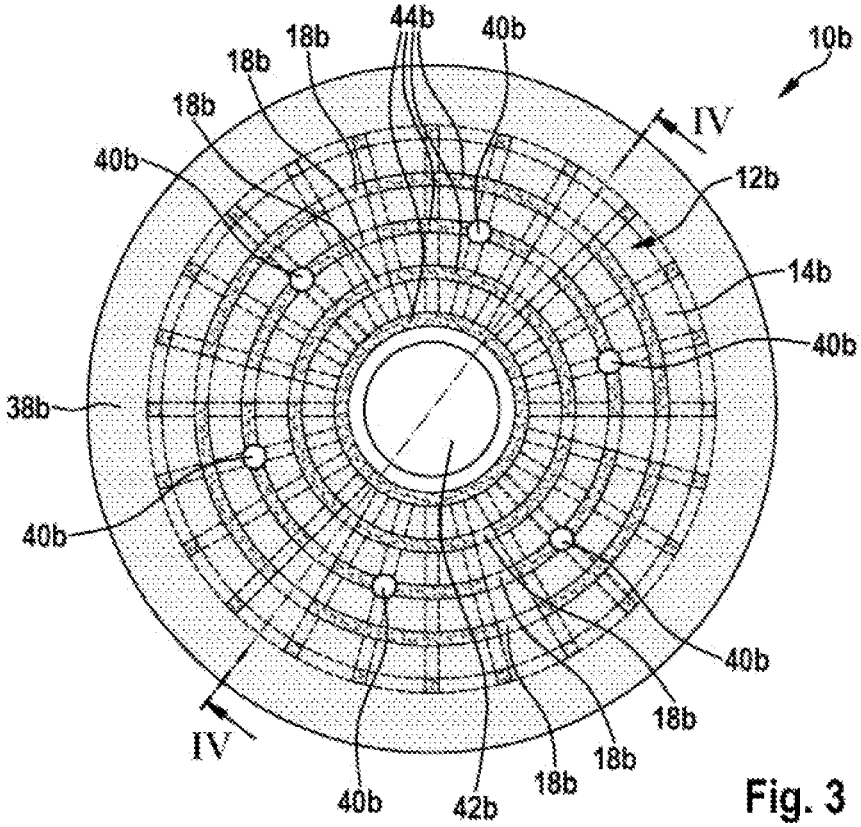
FIG. 3 shows an alternative holding device according to the disclosure having a plurality of material recesses, island-like support protrusions and web elements, which interconnect the island-like support protrusions, in a view from above.
Figure 4:
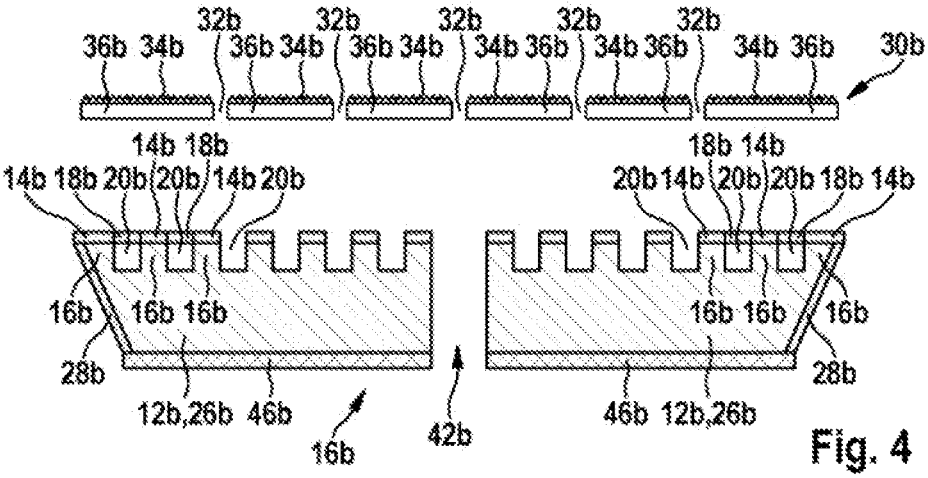
FIG. 4 shows a cross section through the holding device according to the disclosure according to FIG. 3 and a grinding means.

An alternative holding device 10*b* is shown in FIGS. 3 and 4. The holding device 10*b* comprises a support body 12*b* comprising material recesses 20*b*, which are provided for transverse transport on a side facing the grinding means 30*b* in a plane parallel to a grinding face 24*b*, and a securing layer 14*b*, which is formed as a hook-and-loop layer, for securing a grinding means 30*b* on the support body 12*b*. When decoupled from the grinding means 30*b*, the material recesses 20*b* are substantially open on a side facing the grinding means 30*b* and are substantially delimited by the support body 12*b* on a side facing away from the grinding means 30*b* and extend between island-like support protrusions 16*b*. The holding device 10*b* has web elements 18*b*, which interconnect the support protrusions 16*b* and straddle the material recesses 20*b*. The web elements 18*b* are formed integrally with the securing layer 14*b*. Alternatively, the web elements 18*b* can be fabricated separately from foam or plastic. In the state decoupled from the grinding means 30*b* the material recesses 20*b* are furthermore present uncovered to an extent of sixty percent, straddled by the web elements 18*b*. Material recesses 20*b* straddled by web elements 18*b* are marked in the drawing by dashed contours. The support body of the holding device 10*b* also has a peripheral support ring 38*b*, which is free from material recesses 20*b* and is likewise covered by the securing layer 14*b*. A structure of the holding device 10*b* and a function of components of the holding device 10*b* are otherwise completely similar to the previous exemplary embodiment. The web elements 18*b* provide additional securing area compared with the design of the previous exemplary embodiment, whereby a securing of the grinding means 30*b* to the holding device 10*b* achieves a high strength. Due to the web elements 18*b*, the securing layer 14*b* is also formed as a cohesive overall element. Due to the formation of the securing layer 14*b* as a cohesive overall element, a method for producing the holding device 10*b*, in which the support body 12*b* is fabricated by being foamed on against the securing layer 14*b*, can be performed by means of technically simple process steps and using a foaming tool fabricated in a structurally simple manner.

Figure 5:
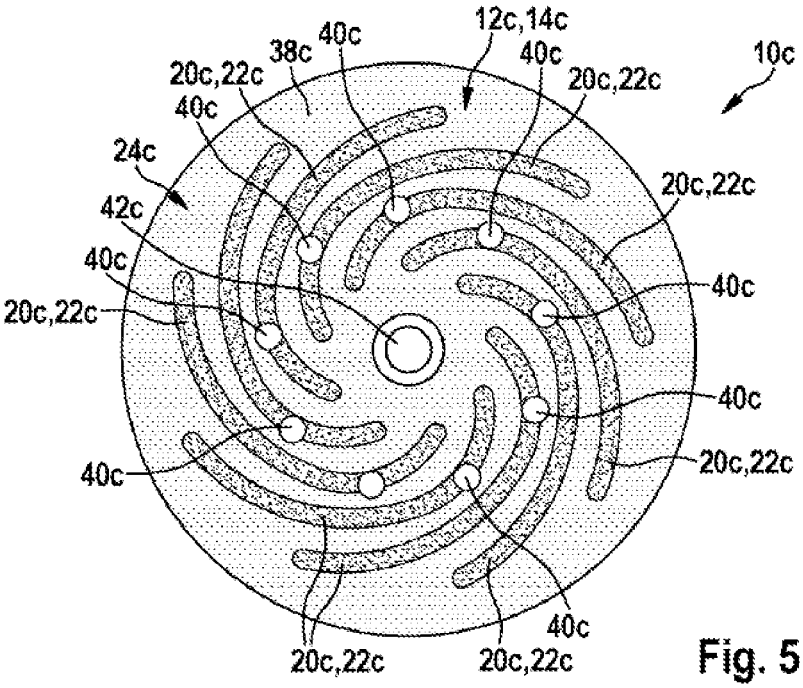
FIG. 5 shows a further alternative holding device, which has a spiral structure of material recesses formed as Fibonacci spiral elements, in a plan view.

A further alternative design of a holding device 10*c* for a grinding means 30*c* is illustrated in FIG. 5. The holding device 10*c* has a support body 12*c* comprising material recesses 20*c*, which are provided for a grinding dust on a side facing the grinding means 30*c* in a plane parallel to a grinding face 24*c*, and also has a securing layer 14*c* for securing the grinding means 30*c* on the support body 12*c*. When decoupled from the grinding means 30*c*, the material recesses 20*c* are substantially open on a side facing the grinding means 30*c* and are substantially delimited by the support body 12*c* on a side facing away from the grinding means 30*c* and are completely uncovered by the securing layer 14*c*, wherein, when decoupled from the grinding means 30*c*, the securing layer 14*c* is arranged on the support body 12*c*, but the grinding means 30*c* is not yet attached to the securing layer 14*c*. The material recesses 20*c* are formed as inner regions of channel elements 22*c*. The channel elements 22*c* are curved and formed as spiral elements, which form spiral arms of a spiral structure. The support body 12*c* has a total of nine curved channel elements, such that the support body 12*c* has a nine-armed spiral structure formed from curved channel elements 22*c*. The material recesses 20*c* formed as inner regions of curved channel elements 22*c* are not connected to one another. The curved channel elements 22*c* are formed as Fibonacci spiral elements, wherein the Fibonacci spiral elements have a course with a design rule by a connection of corner points of adjacent squares arranged in succession in an anticlockwise direction, wherein side lengths of the squares arranged in succession in an anticlockwise direction are arranged in a ratio to one another that is predefined by a Fibonacci sequence, and an orientation of the corner points of successive squares, through which the spiral element extends, likewise alternates in an anticlockwise direction. Due to a course of the Fibonacci spiral elements and a wide-area coverage of a face of the support body 12*c* on the grinding means side, a high likelihood of an overlap of one or more grinding means holes 32*c* of a wide range of different hole patterns of grinding means 30*c* and the material recesses 20*c* formed as Fibonacci spiral elements is achieved, without having to purposefully align the grinding means 30*c* and holding device 10*c* in an aligning step. The support body 12*c* has connection holes 40*c* for connection to a suction device, each of said holes being connected to a material recess 20*c*. The connection holes 40*c* each have a circular diameter, which is greater than a width of the curved channel elements 22*c*. A center hole 42*c* of the support body 12*c* is free, in this design, from a connection to a suction device. Approximately twenty percent of an area of the support body 12*c* on the grinding means side is occupied by the material recesses 20*c*. The support body 12*c* also has a peripheral support ring 38*c*, which is free from material recesses 20*c*. In principle, the peripheral support ring 38*c* could be formed in alternative embodiments as a separate component additionally to the support body 12*c*. In a further alternative design the material recesses 20*c* may be interconnected in principle via a peripheral connection channel in ring form, such that, even when a material recess 20*c* and/or a connection hole 40*c* is/are blocked, grinding dust can be transported to a further connection hole 40*c* via the connection channel.

Figure 6:
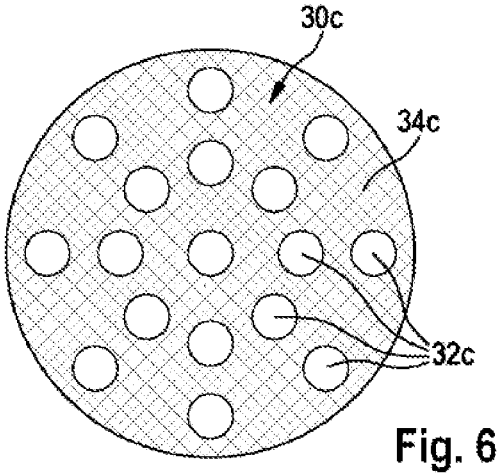
FIG. 6 shows a grinding means with hole pattern, in a view from above.
Figure 7:
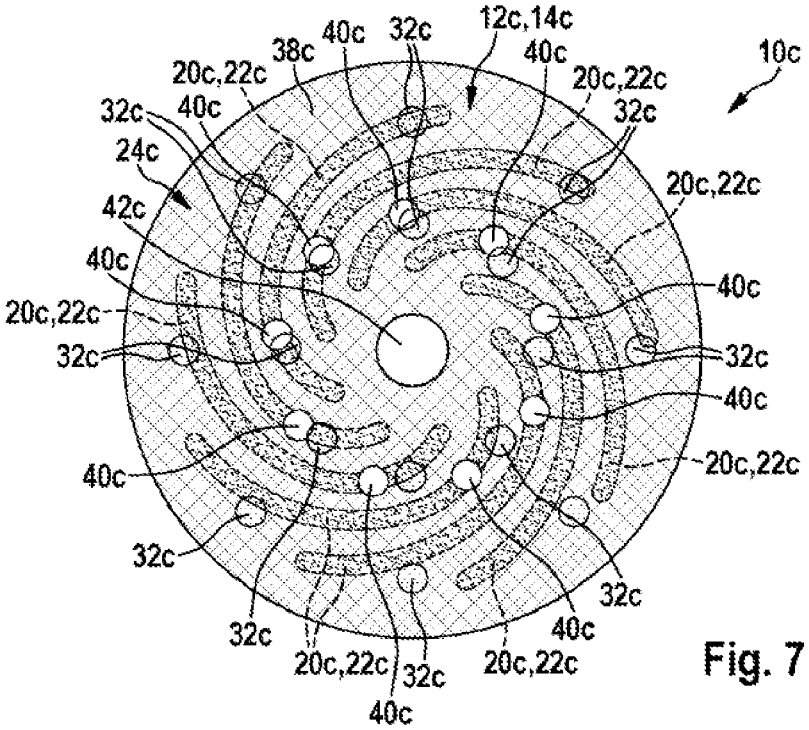
FIG. 7 shows a schematic illustration of an overlap of the hole pattern of the grinding means from FIG. 6 with the spiral structure of the material recesses from FIG. 5.

In FIG. 6 a grinding means 30*c* having a grinding layer 34*c*, which is applied to a grinding means backing 36*c* made of velour (not illustrated), and having a hole pattern formed from seventeen grinding means holes 32*c* is illustrated. FIG. 7 shows the holding device 10*c* from FIG. 5 with a schematically illustrated overlap of the material recesses 20*c* and the grinding means holes 32*c* of the grinding means 30*c* from FIG. 6. Due to the spiral structure of the material recesses 20*c* of the support body 12*c* and a wide-area coverage of a face of the support body 12*c* on the grinding means side, there is a high likelihood of an at least partial overlap of at least one grinding means hole 32*c* for discharging grinding dust and at least one material recess 20*c*, without having to purposefully align the grinding means 30*c* in order to line up the grinding means holes 32*c* and connection holes 40*c* when mounting the grinding means 30*c* on the holding device 10*c*. Further, other hole patterns of grinding means holes 32*c* are also lined up at least partially with the material recesses 20*c* with a high likelihood, without purposeful alignment of the grinding means 30*c*, such that grinding dust is suctioned without any purposeful alignment when mounting the grinding means 30*c* on the holding device 10*c*. The holding device 10*c* can thus be used for grinding means 30*c* having different hole patterns.

Figure 8:
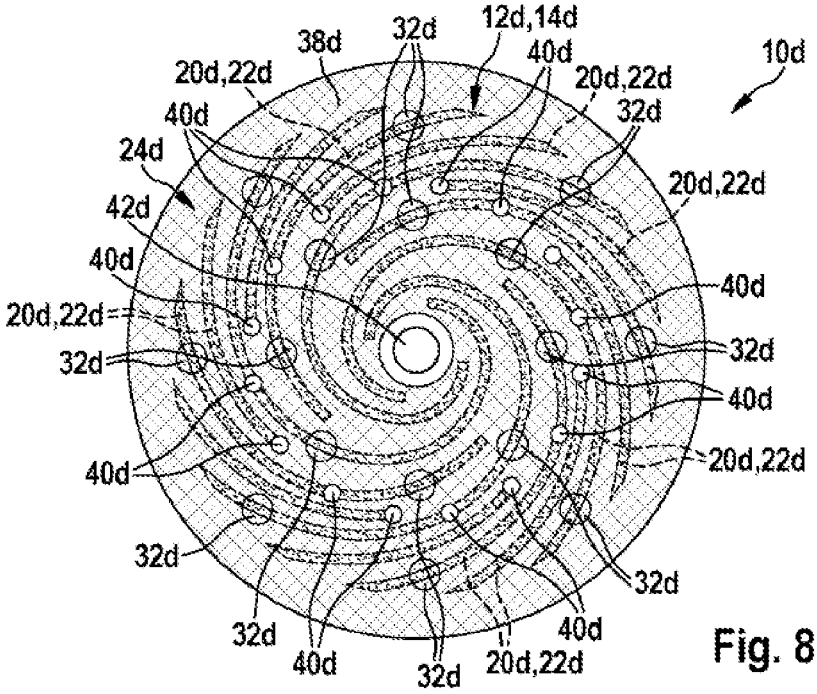
FIG. 8 shows a third alternative holding device with a spiral structure of material recesses formed as Fibonacci spiral elements, in a plan view, together with an overlap of a hole pattern of other grinding means with the spiral structure.

In FIG. 8 a further alternative embodiment of a holding device 10*d* for a grinding means 30*d* is illustrated and is formed similarly to the previous embodiment. The holding device 10*d* comprises a support body 12*d*, the material recesses 20*d*, which are provided for transverse transport of grinding dust on a side facing the grinding means 30*d* in a plane parallel to a grinding face 24*d*, and a securing layer 14*d* for securing the grinding means 30*d* on the support body 12*d*. When decoupled from the grinding means 30*d*, the material recesses 20*d* are substantially open on a side facing the grinding means 30*d*, are substantially delimited by the support body 12*d* on a side facing away from the grinding means 30*d*, and are completely uncovered by the securing layer 14*d*, wherein, when decoupled from the grinding means 30*d*, the securing layer 14*d* is arranged on the support body 12*d*, but the grinding means 30*d* is not yet attached to the securing layer 14*d*. The material recesses 20*d* are also formed as inner regions of curved channel elements 22*d* formed as Fibonacci spiral elements. The support body 12*d*, instead of nine, has a total of sixteen material recesses 20*d*, which are arranged in a spiral structure. Approximately thirty percent of the area of the support body 12*d* on the grinding means side is occupied by material recesses 20*d*. As in the previous example, the support body 12*d* has connection holes 40*d* for a connection to a suction device, wherein each connection hole 40*d* is connected to a material recess 20*d* and the material recesses 20*d* formed as inner regions of curved channel elements 22*d* are not connected to one another. The support body 12*d* also has a peripheral support ring 38*d*, which is free from material recesses 20*c* and forms a peripheral outer edge of the support body 12*d*.

Figure 9:
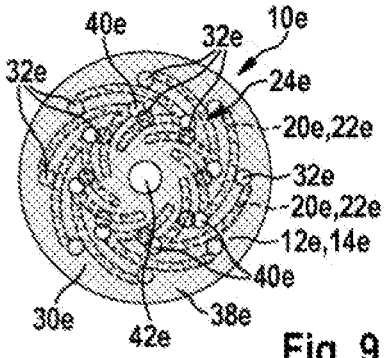
FIG. 9 shows a fourth alternative holding device having a spiral structure formed from V-shaped channel elements.

FIG. 9 shows a further alternative embodiment of a holding device 10*e* for grinding means 30*e*. The holding device 10*e* comprises a support body 12*e*, the material recesses 20*e*, which are provided for transverse transport of grinding dust on a side facing the grinding means 30*e* in a plane parallel to a grinding face 24*e*, and a securing layer 14*e* for securing the grinding means 30*e* on the support body 12*e*. When decoupled from the grinding means 30*e*, the material recesses 20*e* are substantially open on a side facing the grinding means 30*e*, are substantially delimited by the support body 12*e* on a side facing away from the grinding means 30*e*, and are completely uncovered by the securing layer 14*e*, wherein, when decoupled from the grinding means 30*e*, the securing layer 14*e* is arranged on the support body 12*e*, but the grinding means 30*e* is not yet attached to the securing layer 14*e*. The material recesses 20*e* are formed as inner regions of curved channel elements 22*e*. The channel elements 22*e* have a V shape, wherein a connection hole 40*e* for connection to a suction device is arranged at a tip of each V shape. The support body 12*e* of the holding device 10*e* has a total of eight material recesses 20*e*, which are oriented around a center hole 42*e*. The center hole 42*e* is formed as a feed air opening, which is provided for a feed of air to assist the transverse transport of grinding dust.

Figure 10:
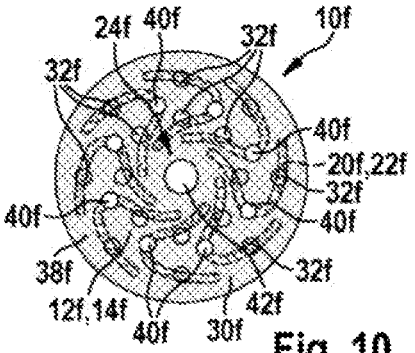
FIG. 10 shows a fifth alternative holding device having a spiral structure formed from U-shaped channel elements.

FIG. 10 shows a further alternative embodiment of a holding device 10*f* for a grinding means 30*f*, which is formed substantially similarly to the preceding embodiment. The embodiment differs from the previous embodiment in terms of a form of the material recesses 20*f*, which are provided for transverse transport of grinding dust on a side facing the grinding means 30*f* in a plane parallel to a grinding face 24*f* and, when decoupled from the grinding means 30*f*, are substantially open on a side facing the grinding means 30*f*, are substantially delimited by the support body 12*f* on a side facing away from the grinding means 30*f*, and are completely uncovered by a securing layer 14*e*. The material recesses 20*f* are formed as inner regions of curved channel elements 22*f*, which have a U shape. A connection hole 40*f* for connection to a suction device is arranged in a middle region of each U shape of the channel elements 22*f*. A total of eight material recesses 20*f* are arranged on the support body and are oriented symmetrically with respect to a center hole 42*f*. The center hole 42*f* is formed as a feed air opening, which is provided for a feed of air to assist the transverse transport of grinding dust.

Figure 11:
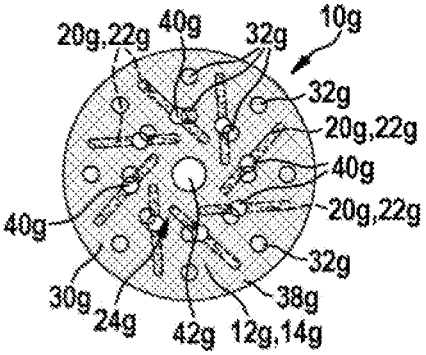
FIG. 11 shows a sixth alternative holding device having material recesses formed as eccentrically arranged channel elements running in straight lines.

A further alternative embodiment of a holding device 10*g* for a grinding means 30*g* has eight material recesses 20*g*, which are provided for transverse transport of grinding dust on a side facing the grinding means 30*g* in a plane parallel to a grinding face 24*g* and which are formed as inner regions of straight channel elements 22*g* (FIG. 11). Another design of a support body 12*g*, a securing layer 14*g*, and the material recesses 20*g* corresponds to those of the previous exemplary embodiments. The material recesses 20*g* are arranged symmetrically with respect to a center hole 42*g* of the support body 12*g*, wherein an orientation between a course of the channel element 22*g* and the center hole 42*g* for each channel element 22*g* is different. The material recesses 20*g* thus have an eccentric arrangement on the support body 12*g*. A connection hole 40*g* for connection to a suction device is arranged in a middle of each material recess 20*g*. The center hole 42*g* is formed as a feed air opening, which is provided for a feed of air to assist the transverse transport of grinding dust.

Figure 12:
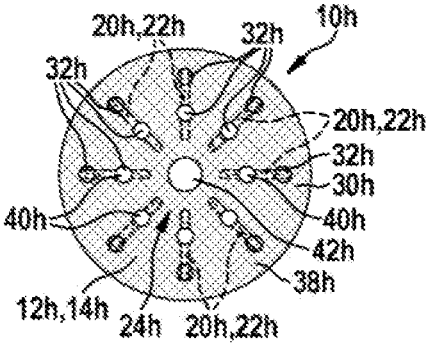
FIG. 12 shows a seventh alternative holding device having material recesses formed as centrally arranged channel elements running in straight lines.

A further alternative embodiment of a holding device 10*h* for a grinding means 30*h* having eight material recesses 20*h*, which are formed as inner regions of straight channel elements 22*h*, is presented in FIG. 12. The holding device 10*h* is formed similarly to the previous exemplary embodiment, apart from an orientation of the channel elements 22*h*. The channel elements 22*h* are oriented identically and point with a direction of a longitudinal extension toward a center hole 42*h* of a support body 12*h*. The material recesses 20*h* thus have an eccentric arrangement on the support body 12*h*. A connection hole 40*h* for connection to a suction device is arranged in a middle of each material recess 20*h*. The center hole 42*h* is formed as a feed air opening, which is provided for a feed of air to assist the transverse transport of grinding dust on a side facing the grinding means 30*h*.

Figure 13:
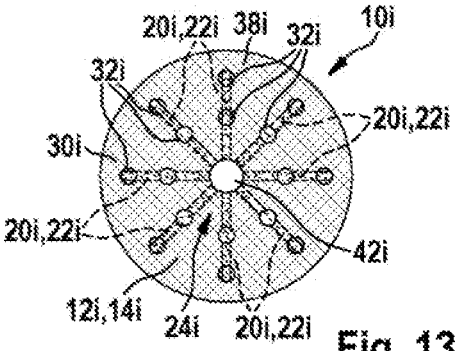
FIG. 13 shows an alternative holding device having material recesses formed as centrally arranged channel elements running in straight lines and connected to a center hole as connection hole to form a suction device.

A further exemplary embodiment of the disclosure, which is fundamentally similar to the preceding exemplary embodiment, is illustrated in FIG. 13. In contrast to the preceding exemplary embodiment, material recesses 20*i* of a support body 12*i* of a holding device 10*i*, which recesses are formed as inner regions of straight channel elements 22*i*, are connected to a center hole 42*i* of the support body 12*i*. The center hole 42*i* of the support body 12*i* is formed as a connection hole 40*h* for connection to a suction device. The rest of the design of the holding device 10*i* is completely similar to that of the previous exemplary embodiment.

The invention claimed is:

1. A holding device for a grinding member, comprising:

at least one support body having at least one material recess configured for transverse transport of grinding dust on a side facing the grinding member in a plane parallel to a grinding face; and at least one securing layer configured to secure the grinding member on the at least one support body, wherein, when decoupled from the grinding member, the at least one material recess is at least substantially open on a side facing the grinding member and is substantially delimited by the support body on a side facing away from the grinding member, and wherein the at least one material recess is configured as an inner region of a peripheral annular channel.

2. The holding device as claimed in claim 1, wherein the at least one material recess is configured as an inner region of a channel element.

3. The holding device as claimed in claim 2, wherein the channel element is at least partially curved.

4. The holding device as claimed in claim 3, wherein the at least partially curved channel element is configured as a Fibonacci spiral element.

5. The holding device as claimed in claim 3, wherein the support body has a spiral structure formed from at least partially curved channel elements.

6. A holding device for a grinding member, comprising:

at least one support body having at least one material recess configured for transverse transport of grinding dust on a side facing the grinding member in a plane parallel to a grinding face; and at least one securing layer configured to secure the grinding member on the at least one support body, wherein, when decoupled from the grinding member, the at least one material recess is at least substantially open on a side facing the grinding member and is substantially delimited by the support body on a side facing away from the grinding member, wherein the at least one material recess is configured as an inner region of a channel element, wherein the channel element is at least partially curved, and wherein the at least partially curved channel element is configured as a Fibonacci spiral element.

7. The holding device as claimed in claim 6, further comprising island-like support protrusions, the at least one material recess arranged between the support protrusions.

8. The holding device as claimed in claim 7, further comprising web elements that interconnect the support protrusions and straddle the at least one material recess.

9. The holding device as claimed in claim 8, wherein the web elements are configured integrally with the securing layer.

10. A holding device for a grinding member, comprising:

at least one support body having at least one material recess configured for transverse transport of grinding dust on a side facing the grinding member in a plane parallel to a grinding face;

at least one securing layer configured to secure the grinding member on the at least one support body; and at least one peripheral support ring that is free from material recesses, wherein, when decoupled from the grinding member, the at least one material recess is at least substantially open on a side facing the grinding member and is substantially delimited by the support body on a side facing away from the grinding member.

11. The holding device as claimed in claim 6, wherein the support body has at least one connection hole configured to connect to a suction device that is connected to the at least one material recess.

12. The holding device as claimed in claim 11, wherein the at least one connection hole is formed by a center hole of the support body.

13. The holding device as claimed in claim 6, further comprising at least one feed air opening configured to feed air to assist the transverse transport of grinding dust.

14. The holding device as claimed in claim 13, wherein the at least one feed air opening is formed by a center hole of the support body.

15. A grinding apparatus, comprising:

a holding device for a grinding member, the holding device including:

at least one support body having at least one material recess configured for transverse transport of grinding dust on a side facing the grinding member in a plane parallel to a grinding face, and at least one securing layer configured to secure the grinding member on the at least one support body, wherein, when decoupled from the grinding member, the at least one material recess is at least substantially open on a side facing the grinding member and is substantially delimited by the support body on a side facing away from the grinding member, wherein the at least one material recess is configured as an inner region of a channel element, wherein the channel element is at least partially curved, and wherein the at least partially curved channel element is configured as a Fibonacci spiral element.

16. The holding device as claimed in claim 6, wherein the grinding member is secured to the support body via the securing layer.

17. The holding device as claimed in claim 6, wherein the holding device is configured as a grinding disk.

* * * * *